US007827631B2

(12) United States Patent
Holman

(10) Patent No.: US 7,827,631 B2
(45) Date of Patent: Nov. 9, 2010

(54) CRIB MATTRESS ELEVATION SYSTEM AND CONTROL UNIT

(76) Inventor: Kathleen Elizabeth Holman, 20 Brinsmayd Ave., Stratford, CT (US) 06614

( * ) Notice: Subject to any disclaimer, the term of this patent is extended or adjusted under 35 U.S.C. 154(b) by 543 days.

(21) Appl. No.: 11/856,803

(22) Filed: Sep. 18, 2007

(65) Prior Publication Data

US 2009/0070929 A1 Mar. 19, 2009

(51) Int. Cl.

| | |
|---|---|
| ***A47D 7/02*** | (2006.01) |
| ***A47D 7/03*** | (2006.01) |
| ***A47D 13/06*** | (2006.01) |
| ***A47C 21/08*** | (2006.01) |

(52) U.S. Cl. ..... 5/93.1; 5/100; 5/11; 5/425; 5/428

(58) Field of Classification Search ..... 5/93.1, 5/100, 11, 611, 616, 600, 424, 425, 428
See application file for complete search history.

(56) References Cited

U.S. PATENT DOCUMENTS

| | | | | |
|---|---|---|---|---|
| 2,262,643 | A * | 11/1941 | McNabb | 5/11 |
| 2,297,963 | A * | 10/1942 | Kroll et al. | 5/11 |
| 2,326,379 | A * | 8/1943 | McNabb et al. | 5/11 |
| 2,397,697 | A * | 4/1946 | Shaw | 5/11 |
| 2,590,337 | A | 3/1952 | McNabb | |
| 2,827,641 | A | 3/1958 | Reichert et al. | |
| 2,913,737 | A | 11/1959 | McNabb | |
| 3,032,154 | A | 5/1962 | McNabb | |
| 4,057,240 | A * | 11/1977 | Damico et al. | 5/611 |
| 4,285,079 | A | 8/1981 | Hillman | |
| 4,837,877 | A | 6/1989 | Hamada et al. | |
| 4,961,236 | A * | 10/1990 | Luconi | 5/616 |
| 4,998,939 | A * | 3/1991 | Potthast et al. | 5/424 |
| 5,214,808 | A | 6/1993 | Schoonover et al. | |
| 6,339,855 | B1 | 1/2002 | Socha et al. | |
| 6,487,735 | B1 * | 12/2002 | Jacques et al. | 5/424 |
| 6,594,837 | B2 * | 7/2003 | Khait | 5/600 |
| 2002/0023297 | A1 * | 2/2002 | Khait | 5/600 |
| 2003/0014817 | A1 * | 1/2003 | Gallant et al. | 5/600 |
| 2003/0066132 | A1 * | 4/2003 | Jacques et al. | 5/424 |
| 2004/0237202 | A1 * | 12/2004 | Gallant et al. | 5/658 |
| 2005/0076439 | A1 * | 4/2005 | Khait | 5/600 |
| 2005/0235418 | A1 * | 10/2005 | Jacques et al. | 5/424 |
| 2009/0070929 | A1 * | 3/2009 | Holman | 5/93.1 |
| 2010/0005586 | A1 * | 1/2010 | Kappenberg | 5/100 |
| 2010/0162482 | A1 * | 7/2010 | Cohen et al. | 5/11 |

* cited by examiner

*Primary Examiner*—Robert G Santos
(74) *Attorney, Agent, or Firm*—William J. Sapone; Coleman Sudol Sapone P.C.

(57) ABSTRACT

A "smart crib" has a frame movably supported by posts, a mattress supported on the frame, the frame being movable between a raised position and a lowered position, a protective enclosure surrounding the frame and mattress, having at least one portion movable between a raised and a lowered position. The crib also includes a first elevation mechanism for moving the frame between the lowered position and the raised position, and a second elevation mechanism for moving the enclosure portion between the raised position and the lowered position. A controller is provided which is responsive to a user's inputs to selectively activate the first elevation mechanism, the second elevation mechanism or both mechanisms to move the frame with the bed and the movable enclosure portion to positions selected by the user between their respective raised and lowered positions, to ease not only placing a baby into the crib, but to also integrate other devices such as baby monitors, temperature and proximity sensors, and even to provide for remote computer access to check in and monitor baby activity.

20 Claims, 5 Drawing Sheets

CRIB MATTRESS ELEVATION SYSTEM AND CONTROL UNIT

TECHNICAL FIELD

This invention relates to baby cribs which have a mattress which may be raised or lowered automatically, preferably in coordination with the raising or lowering of a protective side panel to make it easier to place or remove a baby from the crib, and to a crib control unit which may optionally be incorporated with the crib.

BACKGROUND

Baby cribs are fairly well known to comprise a mattress that is fixed at a relatively low level within a protective enclosure, normally having a pair of side panels that may be manually raised or lowered. The distance between the mattress height and the top of the side panels is set high enough to limit a baby's ability to climb out of the crib.

While offering good protection to most infants, this does require a person to awkwardly bend over the side panels to reach the baby, or to first drop the side panel to move the baby into or out of the crib. Even with the panel lowered, the mattress level is typically at a height which puts strain on the lower back.

In U.S. Pat. No. 3,022,154, a crank mechanism is used to adjust the height of a mattress in a crib, so that this may be raised or lowered. However, this is a fairly time consuming process and often it would be quicker and more convenient to avoid use of the crank. Another drawback is that should the mattress be left at a higher position, for convenience, it makes it more likely that a baby could climb over the enclosure and fall out of the crib.

In U.S. Pat. No. 2,590,337, an electrically powered raising and lowering system uses a pair of limit switches to set an upper position and a lower position, so that by activating a switch mounted on a side of the crib, the mattress is raised until the upper limit switch is contacted, which turns the power off to the unit. Activating the switch again reverses the direction and causes the mattress to be lowered until the lower limit switch is reached. By design, this is a two position system and has the drawback that there is no control between these two positions. Stopping at an intermediate position is not possible.

Another drawback with prior systems is that there is no coordination with the side panel. While the side panel may be manually moved in some cases, the side panel movement is not integrated with a mattress elevation system. Consequently, even with the mattress raised to a certain level, there is some difficulty in placing the baby in the crib, or taking the baby out of the crib.

SUMMARY OF THE INVENTION

It is an object of the present invention to provide a baby crib with an automatic system to raise and lower a crib mattress, preferably in coordination with a side panel, with infinite variability.

It is a further object to provide a baby crib with an automated system which can operate "hands free" so a user can devote full attention to placing a child into or taking the child out of the crib.

It is yet another object to provide a baby crib with an automated mattress raising and lowering system which is safe, yet convenient, preferably having optional user selected preprogramming to further enable customized use.

It is yet another object to provide a baby crib with an automated mattress raising and lowering system with sensors to detect and monitor baby activity in the crib.

It is a further object to provide a baby crib with a controller for monitoring and controlling the various automated features incorporated in the baby crib.

It is yet another object to integrate other auxiliary devices with the controller such as to integrate audio and/or video baby monitoring devices, or wireless or wired communication devices so that the unit can be accessed remotely.

It is yet another object to optimally integrate a temperature sensor to monitor environmental conditions in the crib area, or a capacitive or pressure sensor to determine when a child enters or leaves a crib.

It is a further object to provide integration of an infant stimulation system, such as a music and/or video player to entertain the baby, with the control system.

These and other objects of the present invention are achieved by a baby crib comprising a frame, a bed supported on the frame, the frame being movable between a raised position and a lowered position, a protective enclosure surrounding the frame and bed, having at least one portion movable between a raised and a lowered position, a first elevation mechanism for moving the frame between the lowered position and the raised, and a second elevation mechanism for moving the enclosure portion between the raised and the lowered position and a controller responsive to a user's inputs to selectively activate the first elevation mechanism, the second elevation mechanism or both mechanisms to move the frame with the bed and the movable enclosure portion to positions selected by the user between their respective raised and lowered positions.

Preferably, a switch is provided that can be activated "hands free", such as by using a foot activated switch, or a voice activated switch, so that the user can keep both hands free to devote to care of the baby.

In another embodiment, the controller is programmed by the user to provide customized settings such as, for example, half-way up for the bed, one-quarter down for the enclosure portion, or, movement of the bed only to a ¾ position, or even to adjust the mattress to have an inclined position. Providing a user with the option to customize bed height can significantly improve the convenience for the user of the crib, as well as enhance the comfort and safety of the baby.

Since a controller is available which may have data processing capability, this provides the opportunity to integrate other convenience and safety features such as integrating a baby audio and/or video monitoring system. For example, the crib can be fitted with an integral microphone and speaker, with two way communication devices integrated with the controller. Other options include a crib mounted temperature sensor whose output is received by the controller, to monitor the room temperature to assure that it is comfortable for the child; a proximity sensor can be integrated to note when someone is next to the crib or to detect whether the baby is actually in the crib, etc. By integrating a device in the controller for wired or wireless communication with a local area network, a user has enhanced capabilities for monitoring the baby, and be sent alert messages should any distress occur. This also provides the opportunity to incorporate devices to control, for example, a motorized mobile, to play music or to activate an interactive activity center, where the baby's activities can be both stimulated when appropriate and calmed down when appropriate. With network communication capability, all of this can be done remotely by computer or locally by programming the controller directly.

The present invention provides a user with a "smart" crib, uniquely programmable to their particular needs, to maximize convenience, as well as to optimize the care of the baby.

DETAILED DESCRIPTION OF THE INVENTION

Figure 1:
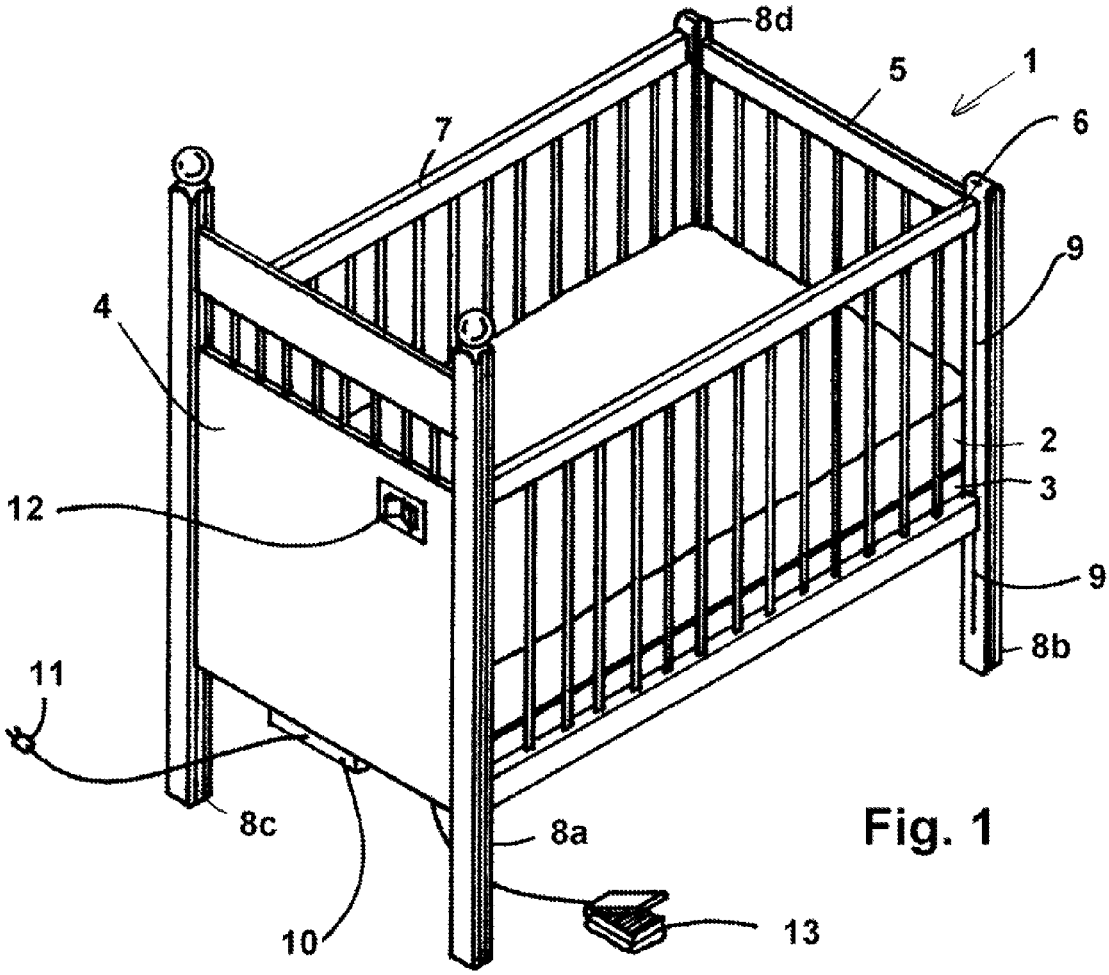
FIG. 1 is a perspective view of a baby crib including the automated raising and lowering system of the invention.

Referring to FIG. 1, a crib 1 has a mattress 2 supported on a frame 3. The frame 3 is integrated with a head panel 4, a foot panel 5 and a pair of side panels 6 and 7.

In this embodiment, which is a typical construction, the crib has four corner posts, 8*a*, 8*b*, 8*c*, 8*d*, the two front posts 8*a* and 8*b* having slide guide channels 9 for supporting the raising and lowering of the side panel 6. In this embodiment, an electric drive motor 10 is mounted beneath the frame, having a conventional power cord 11 for connecting to a power source. Two means of activation are shown, a intermittent push button switch 12 for raising or lowering the frame, depending on whether the switch is pushed to one side or the other, the center position being the normal off position, to which the switch automatically returns in the absence of finger pressure. A foot pedal operator 13 operates in the same way, with stepping on and off reversing the direction so as to provide hands free operation.

Figure 2:
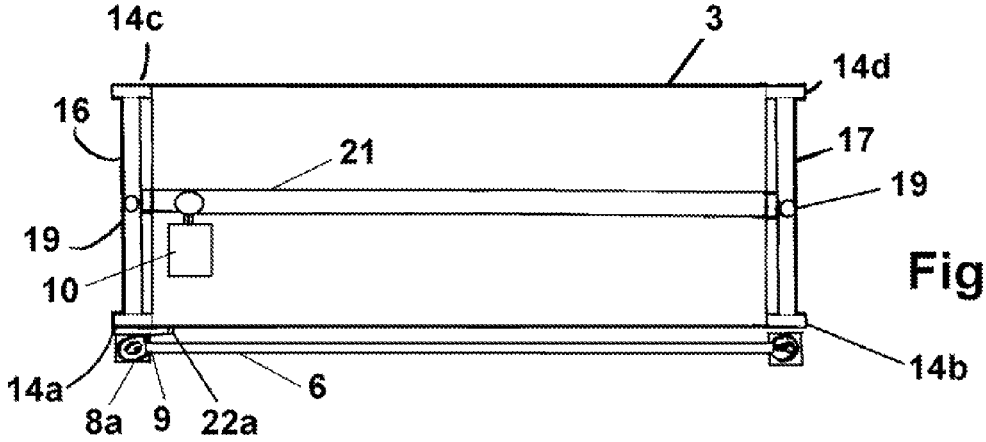
FIG. 2 is a view of a raising/lowering mechanism of the invention.

Referring to FIG. 2, an exemplary mechanism for raising and lowering the crib frame and mattress is shown. For ease of illustration, only the frame and mechanism of operation are shown.

Figure 3:
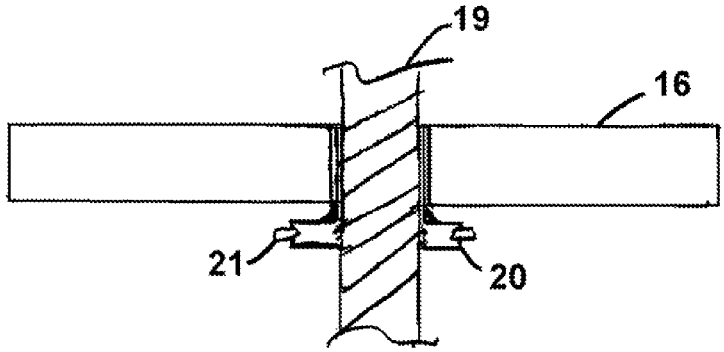
FIG. 3 is a sectional view of the elements of one embodiment of a raising/lowering mechanism for the crib frame and mattress.

The frame 3 has four extensions 14*a*, 14*b*, 14*c*, 14*d*, which are received in slots 15 in the head and foot panels of the crib. The slots act as guides during the raising or lowering of the frame. Connected to these extensions are lifting bars 16 and 17. Each of the lifting bars is supported by a respective threaded shaft (18, 19) which is fixed to the head and foot panels. This is best illustrated in FIG. 3, which shows the mechanism on one side of the crib, the other side being a mirror image thereof.

A threaded nut 20 is threaded onto the shaft and is provided as a lifting gear that is driven by the electric motor either directly or by means of a chain or belt drive. In this embodiment, a belt 21 is wound around the outside of the gear, the belt reversibly driven to cause the nut to move up or down on the threaded shaft. To raise or lower the frame, the motor 10 is activated by the intermittent switch to drive the threaded nuts on the opposite sides of the frame in either a first direction so the lifting bars raise the frame, or the opposite direction so that the lifting bars lower the frame.

In the present invention, the crib frame is operatively connected to the side panel, so that raising the crib frame will simultaneously lower the side panel, to ease placement of the baby in the crib.

Figure 4:
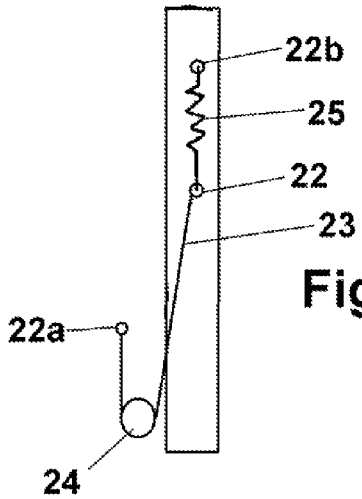
FIG. 4 is a view of a one embodiment of a side panel raising/lowering mechanism.

Referring to FIG. 4, the movable side panel which rides within slots 9 in the front corner posts has a projection 22 for fixing an end of a cable 23 that passes around a pulley 24 and which has its opposite end connected to a frame pin 22*a*. Also connected to the projection 22 is an end of a spring 25, the spring having its opposite end fixed to the adjacent post 8*a* by pin 22*b*, so that as the frame is raised, the cable overcomes the spring bias and the side panel is correspondingly lowered. When the crib frame is lowered, the spring bias pulls the side frame up, to return the side panel to the full upright position. To assure even movement, a second spring may be mounted in the opposite post to provide even pressure when the side panel is raised or lowered.

Figure 5:
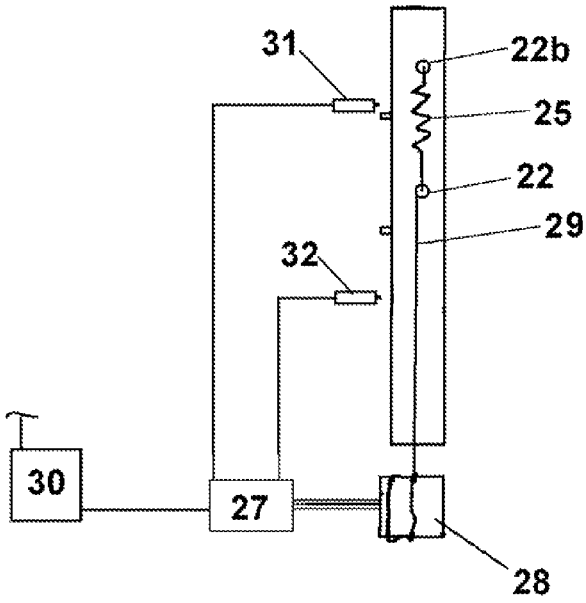
FIG. 5 is an alternative embodiment of a side panel raising/lowering mechanism.

With reference to FIG. 5, an alternative embodiment of the invention has the side panel independently operable using a second motor 27 to drive a pulley 28 to wind up or unwind a cable 29 and thereby move the side panel up or down, again relying on springs 25 to bias the side panel into the full raised position. In this embodiment, coordination with the movement of the frame is accomplished by a controller 30 that provides the user with the ability to select particular operations, such as raise/lower mattress only, raise/lower side panel only, raise/lower the mattress in coordination with the lowering/raising of the side panel, among others.

In this embodiment, limit switches 31, 32 are positioned at the high and low positions of the side frame to halt the second motor operation when those positions are reached. Similar limit switches may be used with the frame raising system, though this can also be accomplished by limiting the length of the threads on which the threaded nut can move, or by providing other physical stops.

Figure 6:
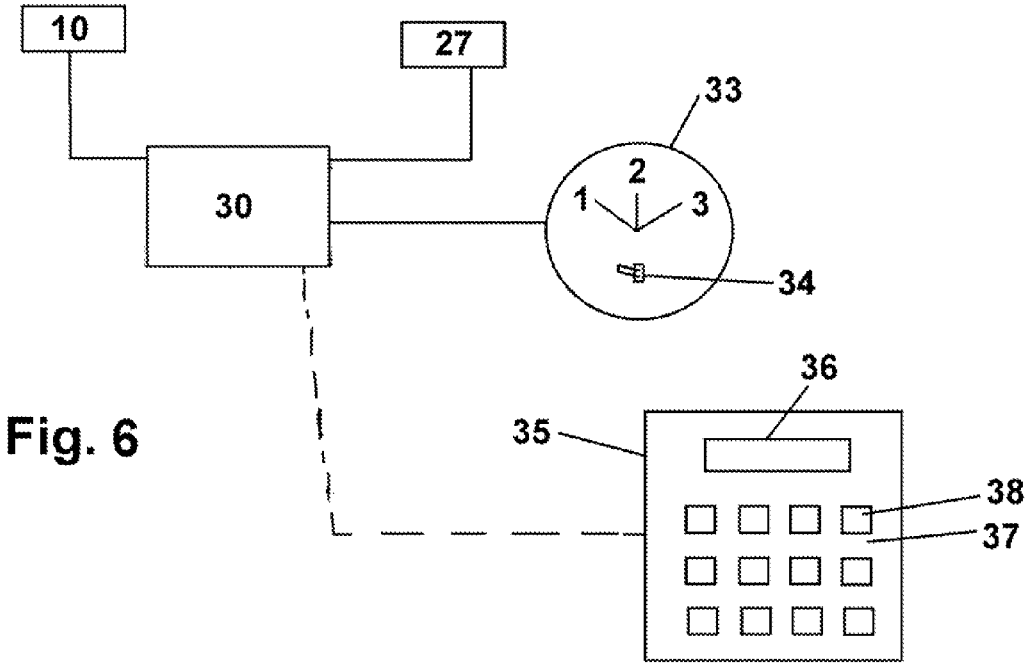
FIG. 6 is a schematic view of the controller and control elements usable with the present invention.

With reference to FIG. 6, the controller 30 is connected to a power source (not shown) and to the frame motor 10 and the side panel motor 27, so as to control their operation. A three position selector switch 33 is provided adjacent to an intermittent three position toggle switch 34, as discussed previously, both of which are connected to the controller 30.

Position 1 selects the simultaneous operation of both motors, position 2 to operation of the crib frame motor only and position 3 to operation of the side panel motor only. When on selector position 1, moving the toggle to one side will raise the frame and lower the side panel. Moving the toggle to the opposite side causes the reverse or opposite operation. If only crib movement is desired, position 2 is selected, and if side panel only movement is desired, position 3 is selected.

While a three position physical selection switch is shown, this can be substituted or simply supplemented by an electronic control panel 35 with an LED display 36, that is, in essence a programmable switch. Then, following a displayed menu, a user simply uses a drop down list to select the desired operation. In place of the physical toggle switch, a pressure sensitive key pad 37 is provided so that pressing a key 38 produces the same operation. Other keys are provided for programming, and these can be used for example to require password entry to effect any changes, so as to prevent inadvertent activation of the system.

This enables a user to pre-program particular desired settings, for example by first setting the position of each of the frame height and side panel height, and then programming the controller to memorize the position so it can be recalled from the drop down menu. This may be, for example, ½ raise of the frame to ¾ lowering of the side panel, or to any other desired positions.

Of course, the foot pedal performs the same operation as the toggle switch, electronic or otherwise, and this can also be integrated with the controller, though the controller provides the ability to program particular positions to achieve when the foot pedal is depressed.

With sufficient processing power provided in the controller, voice activation can additionally be incorporated so as to provide complete hands free and foot free operation. Software exists for accepting voice commands for a controlling a number of different devices, and integration into the controller for crib control is certainly easily accomplished.

In operation, the controller would have a microphone, and voice recognition software, configured to respond to selected users only. The user would have to take the time to program the software, as is typical with such software so the voice can be recognized, but then, when the user approaches the crib, the user issues the pre programmed voice command such as "Position 1" or "Raise mattress only" and the controller would then receive the command, acknowledge and possibly seek confirmation, and then execute the command. After the child is placed in the crib, by voice or switch activation, the frame and/or side panel would move to their newly designated positions.

In yet another embodiment of the invention, a third motor 38 is added at the foot of the frame, so that the head or foot of the crib can be independently raised/lowered to tilt the mattress if so desired. This may be useful to improve comfort, circulation, or breathing, in certain circumstances.

Figure 7:
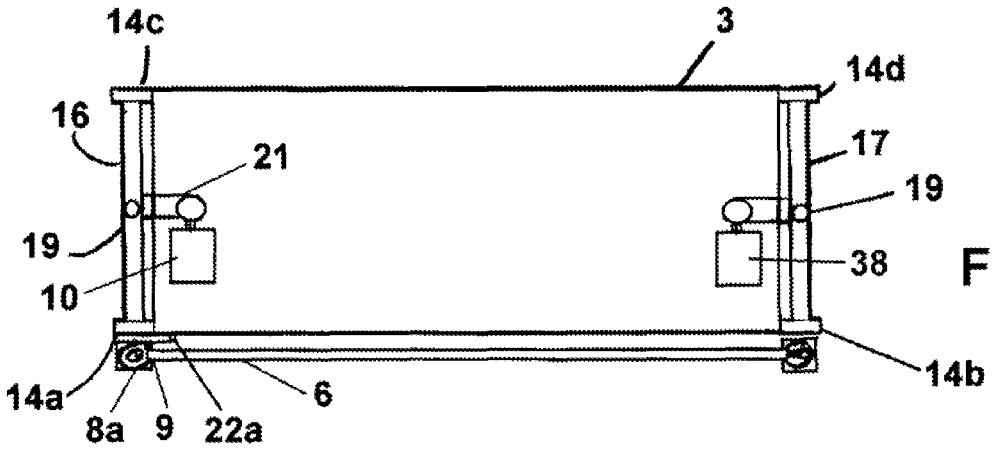
FIG. 7 is a view of an alternative embodiment of the raising/lowering mechanism, having independent motors.
Figure 8:
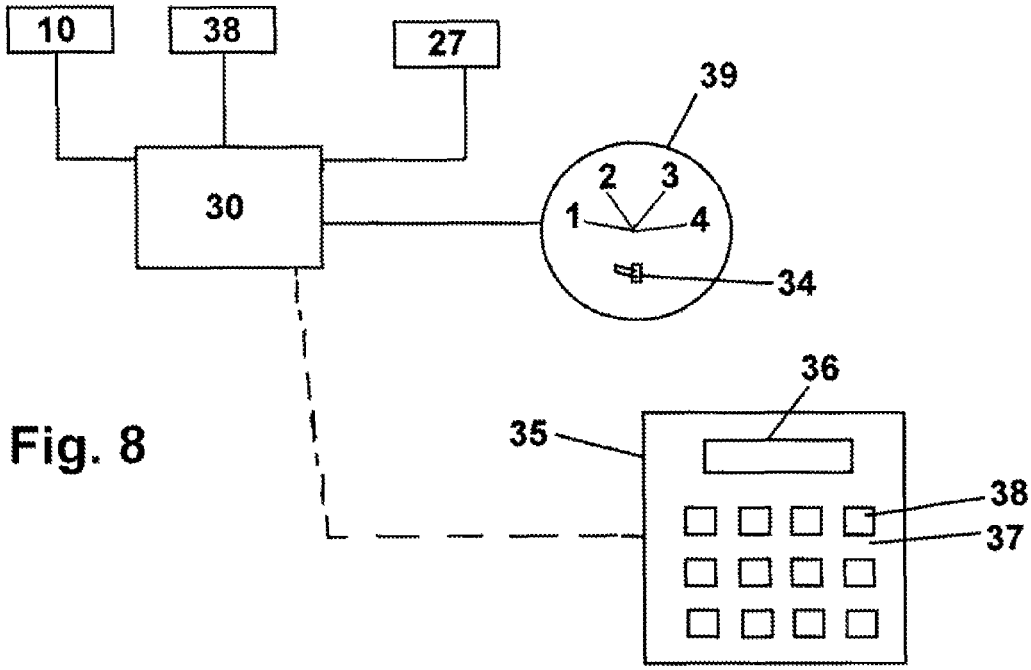
FIG. 8 is a schematic view of an alternative embodiment of a control scheme usable with the present invention.

With reference to FIG. 7, the frame 3 has a motor 10 to drive the head end of the frame, and the motor 38 at the opposite end of the crib frame. Normally, both motors would be operated in tandem, however, with reference to FIG. 8, a fourth selection position is added to the selector switch 39, so that moving the toggle to one side will raise the head of the bed or to the other side will lower the head of the bed. However, the tilted position settings are preferably over ridden when the selection 1 or 2 are set, so as to level the mattress before any further movement occurs. Of course, the electronic control panel 35 can also be programmed to operate in a similar manner, by merely adding this function to the drop down menu or by adding the appropriate voice command.

Figure 9:
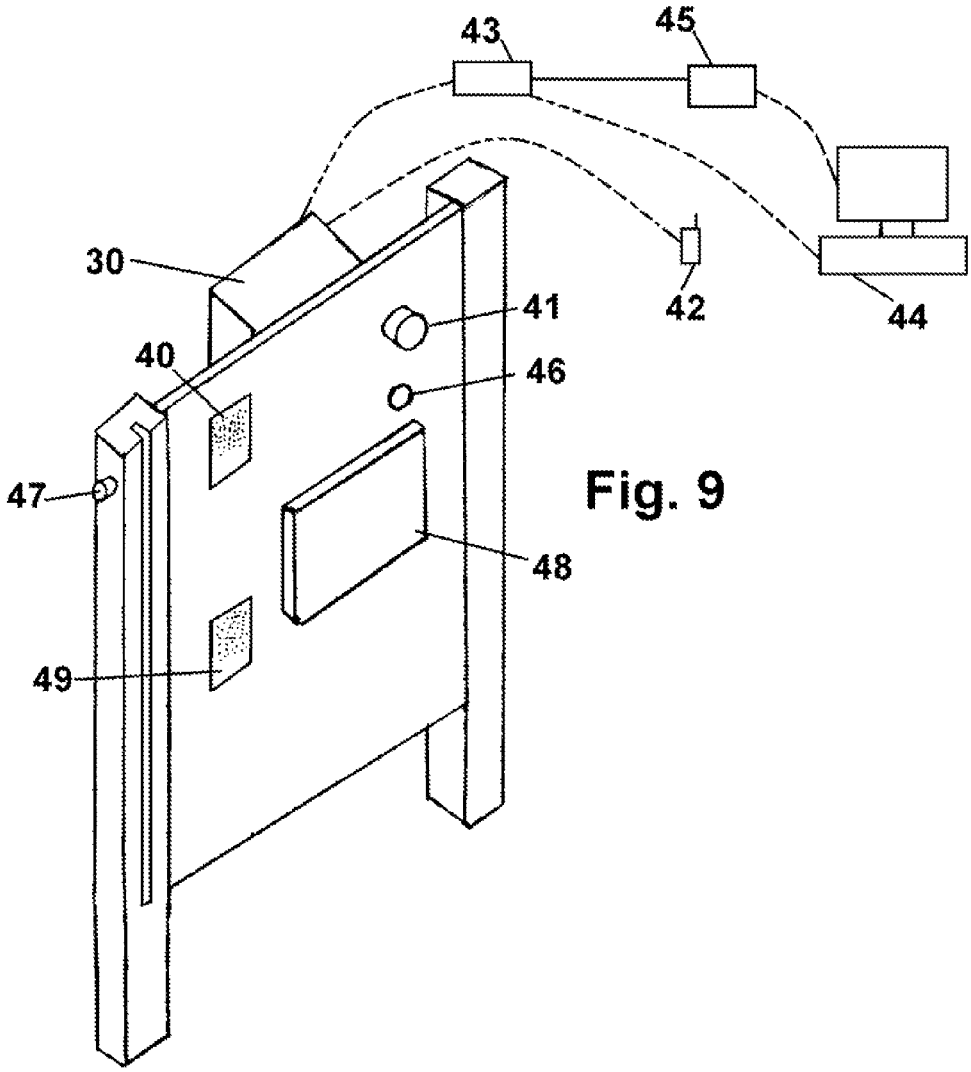
FIG. 9 is a view of a crib mounted controller and various associated devices mounted of a crib head frame.

Referring to FIG. 9, the controller 30 is provided with sufficient data processing capability to enable integrating other auxiliary devices supportive of "smart" crib operation. For example, an audio or video baby monitoring system can be integrated with and powered through the controller. Thus, a microphone 40 and/or a CCD camera 41 can be located in the head board, with the controls for volume, etc. adjusted with the electronic keypad with display as discussed previously. Moreover, the controller can have an integral radio transmitter for communicating with a standard type portable baby monitor 42, as well as be connected to a local area network by hard wire, or preferably have the components for enabling wireless communication, for example, with a router 43 for enabling access over the local area network, either by a local computer 44 or through a modem 45 via an internet connection. Blue tooth or other wireless technology can also be used to communicate with other devices such as cell phones, PDA's or portable computing devices similarly enabled. Consequently, the controller and its devices are configured for remote access. For example, someone working in another room on a computer may listen simultaneously to the baby monitor, or be able to look in using the optional camera.

Other devices that can integrated into the controller include a temperature sensor 46 which issues an alert broadcast if the temperature rises or falls from a predetermined range; a proximity sensor 47 to alert when someone approaches the crib, or to "wake up" the controller from a dormant state to a state ready to accept, for example, voice commands.

Given the ability to receive and transmit sound and pictures, it is equally possible to mount a small flat screen display 48 and speakers 49 for entertainment and stimulation of an infant who is restless, or to provide soothing sounds or video to promote sleep. This can be provided by and activated remotely over the same LAN from a remote computer or by use of the local control panel.

Using the present invention, a "smart crib" can be provided to ease not only placing a baby into the crib, to make it easier to monitor the baby when left in the crib, to adjust for comfort by tilting the mattress, or to entertain the baby, all of which makes it easier for a parent to care for their child.

While preferred embodiments of the present invention have been shown and described, it will be understood by those skilled in the art that various changes or modifications can be made without varying from the spirit and scope of the present invention.

I claim:

1. A baby crib comprising;

a frame movably supported by posts;

a mattress supported on the frame, the frame being adjustably movable to intermediate positions between a raised position and a lowered position;

a protective enclosure surrounding the frame and mattress, having at least one portion adjustably movable to intermediate positions between a raised position and a lowered position;

a first elevation mechanism for adjustably moving the frame between the lowered position and the raised position, and a second elevation mechanism for adjustably moving the enclosure portion between the raised position and the lowered position;

a controller responsive to a user's inputs to selectively activate the first elevation mechanism and the second elevation mechanism simultaneously for moving the frame with the mattress upwardly or downwardly and the movable enclosure portion in a direction opposite thereto to positions selected by the user between their respective raised and lowered positions thereby to ease placement into or removal of a baby from the crib when the mattress is in a raised position with the enclosure portion in a lowered position, and then to return the mattress to the lowered position and the enclosure portion to the raised position after the baby is placed in the crib.

2. The baby crib of claim 1 further comprising a switch that is connected to the controller, the switch being activated without use of the hands.

3. The baby crib of claim 2 wherein the switch is a foot activated switch, or a voice activated switch.

4. The baby crib of claim 1 further comprising a motor for driving the first elevation mechanism.

5. The baby crib of claim 1 wherein the first mechanism is a threaded shaft, the frame being engaged with a threaded gear such that turning the gear raises or lowers the frame.

6. The baby crib of claim 1 wherein the controller is connected to the first and second elevation mechanisms and is capable of being programmed to provide customized height settings of the frame, the movable enclosure portion or both.

7. The baby crib of claim 6 wherein the height setting is selected from the group consisting of part way up for the frame, part way down for the enclosure portion, movement of the frame only to a raised or lowered position, movement of the enclosure portion only to a raised or lowered position.

8. The baby crib of claim 1 further comprising a baby audio and/or video monitoring transmitter integrated with the controller.

9. The baby crib of claim 1 wherein the crib has a two way communication device for establishing communication with a remote device.

10. The baby crib of claim 1 further comprising a crib mounted temperature sensor whose output is received by the controller, to monitor room temperature.

11. The baby crib of claim 1 further comprising a proximity sensor integrated with the crib whose output is received by the controller to note when someone is next to the crib or to detect whether the baby is in or out of the crib.

12. The baby crib of claim 1 further comprising a wired or wireless communication circuit integrated with the controller for communication with a local area network, so that a user can monitor crib activity using a remote device in communication with the controller, or can remotely program the controller, or to allow the controller to send information to the remote communication device.

13. The baby crib of claim 1 wherein the controller controls auxiliary devices selected from the group consisting of a motorized mobile, a music player, an interactive activity center, or a video player.

14. The baby crib of claim 13 wherein the controller is directed to control the auxiliary devices either remotely by communication with a device such as a computer, PDA, smart phone or other communication device or by locally programming the controller using a user interface that may comprise a key pad with programming keys and a display or a touch screen display.

15. The baby crib of claim 1 wherein the second elevation mechanism comprises a cable connected between the frame and the movable enclosure portion, the cable passing around a pulley, such that movement of the frame in one direction displaces the enclosure portion in the opposite direction, and further comprising a spring for biasing the enclosure portion into the raised position.

16. The baby crib of claim 1 wherein the second elevation mechanism comprise a cable connected between the enclosure portion and a wind-up pulley, driven by a motor, and a spring for biasing the enclosure portion into the raised position.

17. The baby crib of claim 4 further comprising a second motor for driving a foot portion of the frame separate from a head portion of the frame such that the frame may be inclined.

18. The baby crib of claim 17 further comprising a multi-position switch for selecting which of the motors connected to the controller will be responsive to user directed commands.

19. The baby crib of claim 1 further comprising an electronic control panel having a display and a manual input key pad for programming and controlling the controller functions.

20. A method for facilitating placing an infant into or taking an infant out of a baby crib comprising;

providing a frame movably supported by posts, a mattress supported on the frame, the frame being adjustably movable to intermediate positions between a raised position and a lowered position;

providing a protective enclosure surrounding the frame and mattress, having at least one portion being adjustably movable to intermediate positions between a raised position and a lowered position;

providing a first elevation mechanism for moving the frame between the lowered position and the raised position, and a second elevation mechanism for moving the enclosure portion between the raised position and the lowered position; and, providing a controller for responding to a user's inputs for selectively activating the first elevation mechanism and the second elevation mechanism simultaneously for moving the frame with the mattress upwardly or downwardly and the movable enclosure portion in a direction opposite thereto to positions selected by the user between their respective raised and lowered positions thereby to ease placement into or removal of a baby from the crib when the mattress is in a raised position with the enclosure portion in a lowered position, and then to return the mattress to the lowered position and the enclosure portion to the raised position after the baby is placed in the crib, programming the controller for providing user selected height settings of the frame, the movable enclosure portion or both, in response to user commands; and, providing a switch connected to the controller for a user to activate the controller without use of the hands.

* * * * *